US009017104B2

(12) United States Patent
Powley

(10) Patent No.: US 9,017,104 B2
(45) Date of Patent: Apr. 28, 2015

(54) ELECTRICAL PLUG CONVERTER

(71) Applicant: Daniel Powley, Fort St. John (CA)

(72) Inventor: Daniel Powley, Fort St. John (CA)

( * ) Notice: Subject to any disclaimer, the term of this patent is extended or adjusted under 35 U.S.C. 154(b) by 0 days.

(21) Appl. No.: 13/799,071

(22) Filed: Mar. 13, 2013

(65) Prior Publication Data

US 2013/0244493 A1 Sep. 19, 2013

Related U.S. Application Data

(60) Provisional application No. 61/610,060, filed on Mar. 13, 2012.

(51) Int. Cl.

| | |
|---|---|
| ***H01R 13/504*** | (2006.01) |
| ***H01R 13/516*** | (2006.01) |
| ***H01R 24/28*** | (2011.01) |
| *H01R 103/00* | (2006.01) |
| *H01R 13/58* | (2006.01) |

(52) U.S. Cl.

CPC ..... *H01R 13/516* (2013.01); *H01R 2103/00* (2013.01); *H01R 13/504* (2013.01); *H01R 13/5833* (2013.01); *H01R 24/28* (2013.01)

(58) Field of Classification Search

USPC ..... 439/668, 692, 694, 599, 152

See application file for complete search history.

(56) References Cited

U.S. PATENT DOCUMENTS

| | | | | | |
|---|---|---|---|---|---|
| 1,981,458 | A | * | 11/1934 | McCloy et al. | 439/599 |
| 3,061,716 | A | * | 10/1962 | Benander | 362/641 |
| 3,787,798 | A | * | 1/1974 | Carissimi et al. | 439/466 |
| 3,975,075 | A | | 8/1976 | Mason | |
| 4,293,172 | A | | 10/1981 | Lingaraju | |
| 4,545,631 | A | | 10/1985 | Zampini | |
| 4,575,704 | A | * | 3/1986 | Pezold | 337/197 |
| 4,850,886 | A | * | 7/1989 | Berke | 439/152 |
| 4,927,376 | A | * | 5/1990 | Dickie | 439/484 |
| D324,029 | S | | 2/1992 | Luu | |
| 5,094,630 | A | | 3/1992 | Jammet | |
| D354,941 | S | | 1/1995 | Lentz et al. | |
| 5,466,165 | A | | 11/1995 | Boesel et al. | |
| D400,855 | S | * | 11/1998 | Lee | D13/138.1 |
| 5,928,020 | A | * | 7/1999 | Bishop et al. | 439/188 |
| 6,027,377 | A | * | 2/2000 | Wang | 439/692 |
| 6,089,924 | A | * | 7/2000 | Wang | 439/694 |
| D450,036 | S | | 11/2001 | Okamoto | |
| 6,692,284 | B1 | * | 2/2004 | Koh | 439/346 |
| 6,736,666 | B2 | * | 5/2004 | Yu | 439/484 |
| 6,966,799 | B1 | * | 11/2005 | Wang | 439/694 |
| 7,220,136 | B1 | * | 5/2007 | Green | 439/106 |
| D596,571 | S | | 7/2009 | Green | |
| 2010/0167596 | A1 | * | 7/2010 | Yang | 439/692 |
| 2013/0244500 | A1 | * | 9/2013 | Stiehl et al. | 439/692 |

* cited by examiner

*Primary Examiner* — Alexander Gilman

(74) *Attorney, Agent, or Firm* — Buckingham, Doolittle & Burroughs, LLC

(57) ABSTRACT

A low profile replacement electrical plug, and more particularly a low profile plug system for use in replacing traditional plugs on power cords is provided. The low profile plug system allows a user to replace existing plugs on power cords with the low profile plug system to lessen the danger of an unsafe electrical condition or a fire should the existing plugs need to be compressed to fit into a space.

12 Claims, 2 Drawing Sheets

ELECTRICAL PLUG CONVERTER

CROSS-REFERENCE

This application claims priority from Provisional Patent Application Ser. No. 61/610,060 filed Mar. 13, 2012.

FIELD OF THE INVENTION

This invention pertains generally to a low profile replacement electrical plug, and more particularly to a low profile plug system for use in replacing traditional plugs on power cords.

BACKGROUND

Although a typical modern home has many electrical outlets, people still attempt to cram extension cords and outlet extenders into each socket. Traditional plugs on power cords extend outward from the socket approximately at least one inch. Furthermore, as most power cords employ an in-line cord with the plug, this distance is at least doubled to approximately two inches or more. Therefore, anything placed near the outlet must be placed at least two inches away from the wall to avoid compromising the cord. As the outlet is blocked from view by furniture or other obstructions, this practice can lead to the electrical cords being bent or broken if enough pressure is applied causing an electrical outage or electrocution hazard. Additionally, the bent live wire can create a spark which may ignite combustible material placed near the outlet such as rugs, furniture, and the like. Even electrical plugs that are not bent stick out from the wall and prevent homeowners from placing furniture close to the wall near the outlet.

Consequently, there exists a need for an alternative to a bulky electrical plug and bent electrical cords at the wall outlet. The present invention discloses a low profile replacement electric plug for replacing existing traditional plugs. The low profile plug may be part of a low profile plug system allowing individuals to replace existing bulky plugs on power cords so that the power cords fit within tighter spaces without the need to bend the power cords at the plug lessening the danger of an unsafe electrical condition decreasing the likelihood of an electrical fire.

SUMMARY

The following presents a simplified summary in order to provide a basic understanding of some aspects of the disclosed invention. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises a low profile plug for an existing traditional power cord for an appliance, extension cord, power tool, and the like. The low profile plug comprises a pair of contact blades molded into a body with a plurality of cavities molded or cut into a back surface of the body for receiving a plurality of conductor wires from a power cord. The power cord enters the body of the low profile plug from a bottom side so that the power cord runs substantially perpendicular to an outlet saving space between a wall and obstructions such as furniture.

Furthermore in a preferred embodiment of the present invention, the low profile plug is part of a low profile plug system for replacing at least two existing plugs of power cords. The low profile system comprises a first and a second low profile plug allowing a user to make full use of the outlet while still keeping the low profile benefits. The second low profile plug is thinner than the first low profile plug allowing the power cord from the first low profile plug to maintain its alignment without bending. The power cord from the first low profile plug is held in place along the second low profile plug with a wire clip molded into a back cover plate on the second low profile plug. Furthermore, the low profile plug system may be presented as a kit with additional tools to aid in conversion of existing electrical cords.

To the accomplishment of the foregoing and related ends, certain illustrative aspects are described herein in connection with the following description and the annexed drawings. These aspects are indicative of the various ways in which the principles disclosed herein can be practiced and all aspects and equivalents thereof are intended to be within the scope of the claimed subject matter. Other advantages and novel features will become apparent from the following detailed description when considered in conjunction with the drawings.

DETAILED DESCRIPTION

Figure 1:
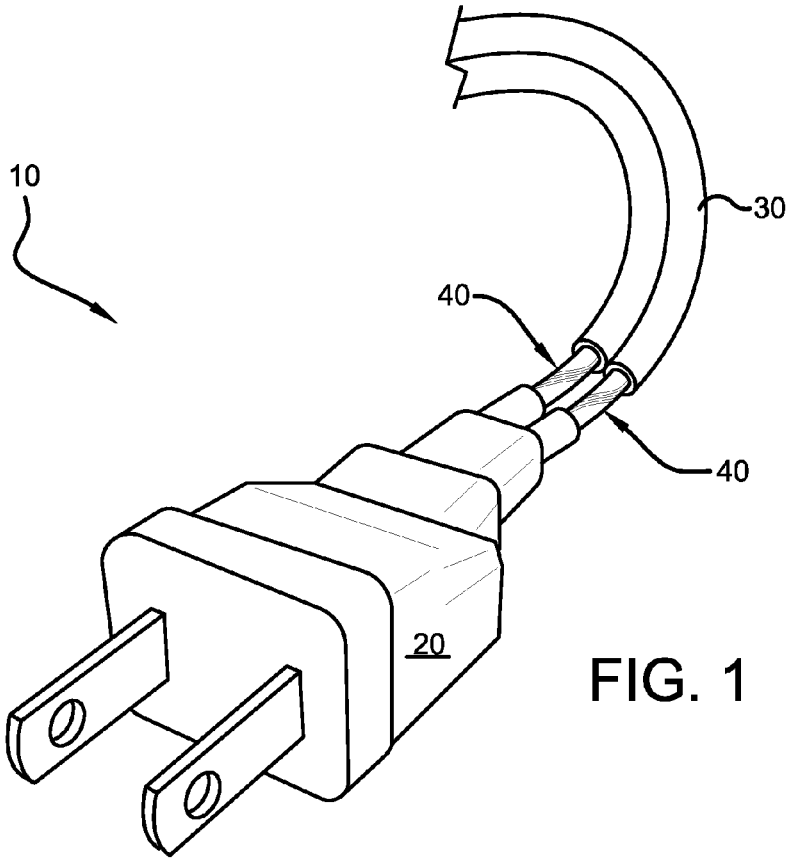
FIG. 1 illustrates a prior art electrical cord in use with an electrical outlet.

Reference is now made to the drawings, wherein like reference numerals are used to refer to like elements throughout. In the following description, for purposes of explanation, numerous specific details are set forth in order to provide a thorough understanding thereof. It may be evident, however, that the novel embodiments can be practiced without these specific details. In other instances, well known structures and devices are shown in block diagram form in order to facilitate a description thereof. The intention is to cover all modifications, equivalents, and alternatives falling within the spirit and scope of the claimed subject matter.

The present invention discloses a low profile plug system for use with electrical cords. The preferred embodiment allows a user to quickly and easily convert existing power cords having traditional plugs with the safer low profile plug system. The low profile plug system provides a simple to install alternative for upgrading electrical safety without the need to sacrifice space. A low profile plug system kit is also provided.

Referring initially to the drawings, FIG. 1 illustrates a prior art existing electrical cord 10 for an appliance, a lamp, a tool, an electronics component, and the like. The existing electrical cord 10 typically comprises a plug 20 and a power cord 30 holding a plurality of conductor wires 40. The plug 20 is typically at least one inch in length with the power cord 30 extending substantially in-line from the plug 20. As such, at least a two inch clearance from an outlet 50 is typically required to avoid compromising the integrity of the plurality of conductor wires 40 housed within the plug 20 and power cord 30.

Figure 2:
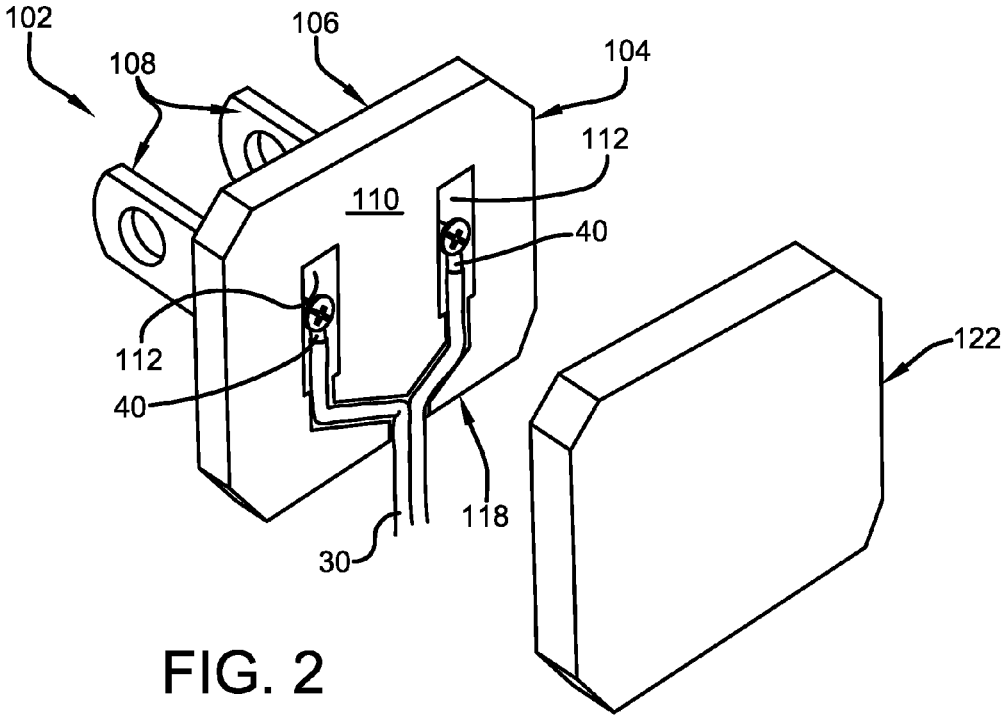
FIG. 2 illustrates an exploded view of a low profile plug for an electrical cord in accordance with the disclosed architecture.
Figure 3:
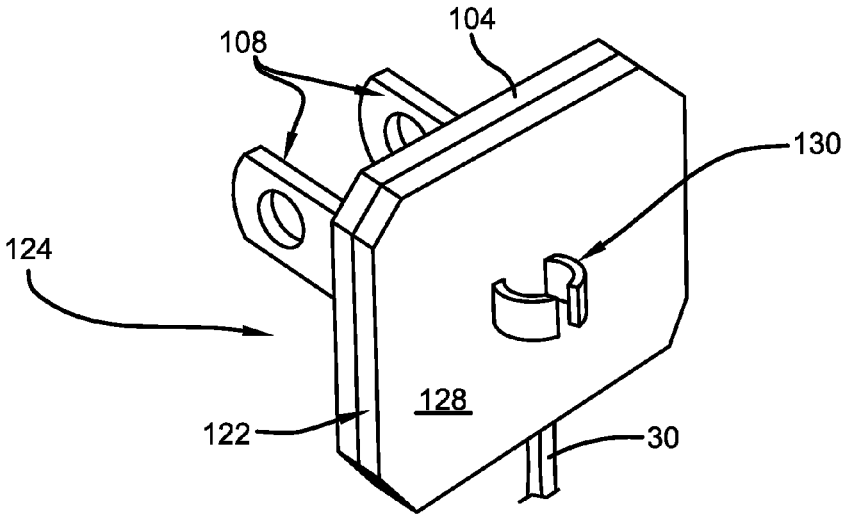
FIG. 3 illustrates a perspective view of a low profile plug system in accordance with the disclosed architecture.
Figure 4:
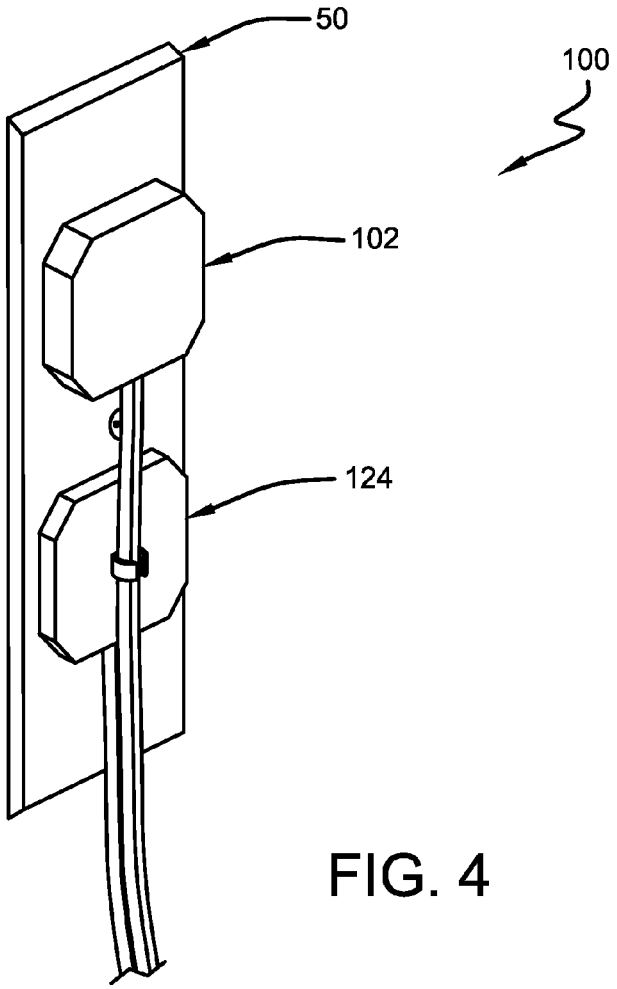
FIG. 4 illustrates a side view of the low profile plug system plugged into a wall outlet in accordance with the disclosed architecture.

FIGS. 2-4 illustrate a low profile plug system 100 for replacing the plug 20 of the existing electrical cord 10. As illustrated in FIGS. 2 and 3, the low profile plug system 100 comprises at least a first low profile plug 102. The first low profile plug 102 comprises a body 104, a pair of contact blades 108, and a back cover plate 122. The body 104 comprises a front surface 106, a back surface 110, and a bottom side 118. The body 104 is preferable constructed from a non-conductive material such as plastic, although it is contemplated that other suitable non-conductive materials can be used, including without limitation polymers, poly vinyl chloride, and the like without affecting the overall scope of the invention. The body 104 typically comprises a substantially square or rectangular shape, approximately between 1¼ inches by 1½ inches in length and width and approximately between ½ and 1 inches in thickness between the front surface 106 and the back surface 110. However, this is not meant as a limitation as the body 104 may be of larger and/or smaller dimensions without deviating from the scope of the invention.

The first low profile plug 102 further comprises a pair of contact cavities 112 and a wire cavity 114 molded within the back surface 110 of the body 104. The pair of contact cavities 112 are preferably generally rectangular in shape and located substantially behind the location of the pair of contact blades 108. The pair of contact blades 108 extend outward substantially perpendicularly from the front surface 106 of the body 104. However, the pair of contact blades 108 also penetrate into the body 104. Preferably, the pair of contact blades 108 are molded into the body 104 so as at least a portion of the pair of contact blades 108 penetrate into one of the pair of contact cavities 112. The pair of contact cavities 112 extends inwardly from the back surface 110. The minimum depth of the pair of contact cavities 112 is only limited by a diameter of the conductor wires 40 of the existing power cord 10. In other words, the conductor wires 40 must be able to completely fit within the pair of contact cavities 112 once the back cover plate 122 is installed.

The wire cavity 114 is similarly molded into the back surface 110 of the body 104. The wire cavity 114 is generally Y-shaped with a bottom of the Y entering the body 104 from the bottom side 118 and branching apart to terminate in the pair of contact cavities 112, however the wire cavity 114 may be generally U-shaped as well. To replace the plug 20 of the existing electrical cord 10, a user cuts off the plug 20 and splits the power cord 30 so that approximately a ½ inch of the conductor wires 40 are separated. Approximately a ¼ inch of insulation is then removed from around each conductor wire 40. The power cord 30 may then be placed within the wire cavity 114 so that the separated conductor wires 40 each extend into one of the pair of contact cavities 112.

The first low profile plug 102 further comprises a pair of attachment elements 120 for electrically connecting the conductor wires 40 of the existing electrical cord 10 to the pair of contact blades 108. As each of the conductor wires 40 enters one of the pair of contact cavities 112, the conductor wires 40 are connected to one of the pair of contact blades 108. The pair of attachment elements 120 are typically a pair of wire screws, although any other electrical connectors known in the art may be used as well. In the preferred embodiment, an electrical terminal, such as but not limited to, a fork connector or a ring connector may be attached to each of the conductor wires 40 so that the electrical terminal may be screwed onto each of the pair of contact blades 108 with one of the wire screws to ensure a safe connection. Once the connection is complete, the back cover plate 122 is attached to the back surface 110 of the body 104 completely encapsulating the electrical connection, and the first low profile plug 102 is ready to be plugged into the outlet 50 for use.

As illustrated in FIGS. 3-4, the low profile plug system 100 further comprises a second low profile plug 124. The second low profile plug 124 is substantially identical to the first low profile plug 124 as described supra, with the following differences. The body 104 of the second low profile plug 124 is approximately between ¼ and ⅝ inches thick and thinner than the first low profile plug 102 body. Additionally, the back cover plate 122 comprises a wire clip 130 molded onto or otherwise attached to an outside portion 128 of the back cover plate 122.

The low profile plug system 100 allows the user to utilize an entire outlet 50 while maintaining the benefits of the low profile plug system 100. As the body 104 of the second low profile plug 124 is thinner than the first low profile plug 102, the first low profile plug 102 preferably engages a top plug of the outlet 50. The power cord 30 attached to the first low profile plug 102 extends out of the bottom 118 of the first low profile plug 102 substantially in-line with the outlet 50. The thinner second low profile plug 124 allows the user to engage a bottom plug of the outlet 50, and permits the power cord 30 attached to the first low profile plug 102 to run along the back plate cover 122 of the second low profile plug 124 without bending the conductor wires 40 or sacrificing space. The power cord 30 attached to the first low profile plug 102 is also held securely and neatly in place with the wire clip 130 on the back plate cover 122 of the second low profile plug 124.

In another embodiment of the invention, an electrical plug conversion kit comprises the first low profile plug 102, the second low profile plug 124, a wire stripper, and a screw driver. As such, the user may easily convert one or more existing electrical cords 10 to the low profile plug system 100. The electrical plug conversion kit may further comprise a plurality of terminals such as fork connectors and an adhesive for permanently attaching the back cover plates 122 to the back sides 110 of the bodies 104.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A low profile plug system for replacing a pair of existing electrical plugs on a pair of electrical cords, the low profile plug system comprising:

a first plug comprising:

a first body comprising a front surface, a back surface, and a bottom side;

a pair of contact blades molded into the front surface of the first body extending outward;

a pair of contact cavities molded into the back surface of the first body, wherein a portion of the pair of contact blades penetrate through the first body into the pair of contact cavities; and a pair of attachment elements for connecting one of the pair of electrical cords to the pair of contact blades;

a wire cavity molded into the back surface of the first body and extending from the bottom side of the first body into the pair of contact cavities, wherein one of the pair of electrical cords extends out of the bottom side of the first body substantially in-line with an electrical outlet; and a first back cover plate for covering the back surface of the first body; and a second plug comprising:

a second body, wherein the second body is thinner than the first body so that the one of the pair of electrical cords extending out of the bottom side of the first body substantially in-line with an electrical outlet will not bend as it extends over the second body; and a second back cover plate for covering the back surface of the second body and comprising an inside portion and an outside portion, the outside portion comprising a wire clip for holding the wire from the first plug.

2. The low profile plug system of claim 1, wherein the second body further comprises:

a pair of contact blades extending outward from the front surface of the second body;

a pair of contact cavities molded into the back surface of the second body substantially behind the contact blades; and a pair of attachment elements for connecting one of the pair of electrical cords to the pair of contact blades; and a wire cavity molded into the back surface of the second body extending from the bottom side of the body into the pair of contact cavities.

3. The low profile plug system of claim 2, wherein the second body is at least ⅛ inches thinner than the first body.

4. The low profile plug system of claim 1, wherein each of the pairs of contact cavities are substantially rectangular in shape.

5. The low profile plug system of claim 1, wherein each of the wire cavities are generally Y-shaped.

6. The low profile plug system of claim 1, wherein each of the pair of electrical cords are spliced into a first conductor wire and a second conductor wire, and wherein each of the conductor wires terminate into one of the pair of contact cavities for connection to either the first plug or the second plug.

7. The low profile plug system of claim 1, wherein a plurality of terminals are attachable to the first conductor wire and the second conductor wire for connecting to the contact blades.

8. The low profile plug system of claim 1, wherein the first plug engages a top plug of an outlet and the second plug engages a bottom plug of the outlet.

9. The low profile plug system of claim 1, wherein the electrical cord extending from the first plug is held substantially in-line with the second plug by the wire clip on the second back cover plate.

10. An electrical plug conversion kit for replacing a pair of electrical plugs with a pair of low profile electrical plugs, the electrical plug conversion kit comprising:

a low profile plug system for replacing the pair of existing electrical plugs on a pair of electrical cords, the low profile plug system comprising:

a first low profile plug, wherein one of the pair of electrical cords extends out of a bottom side of the first low profile plug substantially in-line with an electrical outlet; and a second low profile plug, wherein the second low profile plug is thinner than the first low profile plug and the second low profile plug comprises a wire clip so that the one of the pair of electrical cords extending out of the bottom side of the first low profile plug is substantially in-line with the second low profile plug and will not bend as it extends over the second low profile plug; and a wire stripper; and a screw driver.

11. The kit of claim 10, further comprising a plurality of fork terminals.

12. The kit of claim 10, further comprising an adhesive.

* * * * *